United States Patent [19]

Bernatt et al.

[11] 4,126,773

[45] Nov. 21, 1978

[54] POLYPHASE DISCONNECTING SWITCH ARRANGEMENT

[75] Inventors: Joseph Bernatt, Arlington Hts.; Karel Vojta, Chicago, both of Ill.

[73] Assignee: S&C Electric Company, Chicago, Ill.

[21] Appl. No.: 775,903

[22] Filed: Mar. 9, 1977

[51] Int. Cl.[2] ..... H01H 33/12

[52] U.S. Cl. ..... 200/146 R; 200/144 R

[58] Field of Search ..... 200/146 R, 144 R, 18

[56] References Cited

U.S. PATENT DOCUMENTS

| | | | |
|---|---|---|---|
| 2,954,450 | 9/1960 | Mikos | 200/146 R |
| 3,265,842 | 8/1966 | Pokorny | 200/144 R |
| 3,626,126 | 12/1971 | Pesch | 200/144 R |
| 3,787,651 | 1/1974 | Chabala et al. | 200/146 R |
| 3,914,571 | 10/1975 | Kellogg et al. | 200/18 |

*Primary Examiner*—Robert S. Macon

*Attorney, Agent, or Firm*—Kirkland & Ellis

[57] ABSTRACT

Disclosed is a family of polyphase outdoor interrupter switch arrangements suitable for service in power systems rated up to 34.5 kv with but a single interrupting switch unit per phase. Two insulators are mounted on a base member with one insulator supporting a switch blade hinge assembly and the other insulator supporting an electrical jaw contact and interrupting unit. A linkage arrangement mounted to the hinge assembly connects the movable blade to an insulating push rod. The two supporting insulators remain stationary when the switch operates, and only the insulating push rod moves to provide the motive force. The insulating push rod is connected to a lever mounted on a polygon-shaped (preferably hexagonally-shaped) shaft which is mounted for rotation on the base member. A drive lever and connecting linkage is also connected to the shaft. A movable operating rod is connected to a remote switch operator and to the connecting linkage so that movement of the operating rod rotates the shaft to cause the push rod to pivot the switch to an open position for example. A unique clamping arrangement is provided to permit the various levers to be rigidly affixed to the shaft at any longitudional position without the need for special machining of the shaft. After the switch is open, the insulating push rod and lever form an over-center toggle which prevents the switch blade from being pushed back into the stationary electrical contact as a result of external forces such as wind, etc.

16 Claims, 17 Drawing Figures

10
1
12
14
16
18
19
20
22
28
30
32
34
36
40
42
49
54
56
68
70
72
74
76
79
84
88
94
99
100
102
104
106
110
116
117
118
A 10
14
18
19
20
22
84
92
96
116
117
172
174
176
180
182
184
188
190

13
10
116
114
108
110
14
130
12
106
18
92
132
124
128
122
126
18
104
102
18
22
22
1
48
50
58
40
48
50
58
40
48
50
58
40

94
92

94
160
166
92
168

162
160
164
163
C 115
116
200
94
160
224
212
160
92
14

POLYPHASE DISCONNECTING SWITCH ARRANGEMENT

BACKGROUND OF THE INVENTION

1. Field of the Invention

The present invention relates to high voltage polyphase disconnecting switch arrangements and more particularly to three phase switch arrangements for high voltage power distribution systems.

2. Description of the Prior Art

High voltage polyphase disconnecting switch arrangements are known to the art. For example, U.S. Pat. No. 3,647,966-Bernatt, assigned to the same assignee as the present invention discloses a polyphase disconnecting switch for high voltage circuits having a conductor at each apex of a triangle. Similarly, U.S. Pat. No. 3,705,279-Kerr discloses a typical double blade disconnect switch arrangement. Typically, such high voltage switch arrangements utilize a rotatably mounted insulator having the switch blade mounted to one end thereof which is rotated to cause the switch blade to pivot away from a stationary contact.

Such switch arrangements typically utilize a parallel interrupter switch arrangement to provide a parallel current path for current flow while the switch blade is being opened so that an exposed electrical arc will not be formed, but which operates to internally interrupt current once the switch blade has moved a sufficient distance away from the stationary contact so that an electrical arc will not be formed. A representative example of such an interrupter unit is disclosed in U.S. Pat. No. 3,909,570-Harner, et al. This high voltage circuit interrupter switch arrangement is specifically designed to interrupt current in disconnect switch arrangements of the type herein.

High voltage polyphase disconnecting switch arrangements typically known to the art are designed for specific applications. Such prior art switch arrangements have not permitted the high degree of flexibility in tailoring the switch arrangement to the needs of a specific customer. Because of the diverse power line and utility pole configurations, it would be a very desirable advance in the art to provide a high voltage polyphase disconnecting switch arrangement which permits a high degree of flexibility in configuration so that it may be utilized on a variety of diverse transmission systems.

BRIEF SUMMARY OF THE INVENTION

A polyphase disconnecting switch arrangement in accordance with the present invention comprises a base member mounted to a utility pole having a polygon-shaped shaft mounted for rotation on the base member. A first lever is mounted on the shaft for rotating the shaft. Means for pivoting the first lever is provided to rotate the shaft. At least one set of first and second arms is mounted on the base member and extends outwardly therefrom. First and second insulators are respectively mounted on the extended ends of the first and second arms and stationary electrical contact means is mounted on the first insulator. An interrupter switch means is mounted on the stationary electrical contact. A switch blade means is pivotably mounted on the second insulator, and when the arrangement is closed the switch blade means engages the stationary electrical contact means to complete an electrical circuit. The switch blade means is pivotable to disengage the stationary electrical contact means to disconnect the circuit. A second lever is mounted at one end on the shaft adjacent the first and second arms. A push rod insulator is pivotably connected at one end to the other end of the second lever. Also provided are means connecting the other end of the push rod insulator with the switch blade means so that when the means for pivoting the first lever rotates the shaft, the second lever causes the push rod insulator to pivot the switch blade means to disengage the stationary contact means while the switch blade means maintains electrical circuit connection through the interrupter switch means. The interrupter switch means is operable to interrupt current flow when the switch blade means is sufficiently separated from the stationary contact means to prevent formation of an electrical arc between the switch blade means and the stationary contact means.

The first and second levers can be locked to the shaft and adjustably positioned along the length of the shaft by a locking means. The locking means comprises a locking member having a polygonally-shaped opening formed therethrough dimensioned to slidably mate with the shaft. The opening is formed at an angle with respect to the plane of the locking member such that when the locking member is bolted to the levers, the edge of the opening engages the shaft locking the levers to the shaft.

The present invention may also be arranged in a typical triangular configuration to permit convenient utilization in high-voltage distribution systems having conductors arranged in a triangular configuration. In this arrangement, a second base member is mounted to the first base member and extends upwardly and perpendicularly to the first base member. The first and second arms, the first and second insulators, the switch blade means, and the stationary electrical contact means are mounted on the ends of the first base member as well as on the extending end of the second base member. A second hexagonal shaft is mounted for rotation at the end of the second base member. A third lever is mounted to the end of the second hexagonal shaft and connected to the first lever by a connecting link so that when the first lever is rotated, the second lever is rotated thereby causing both the first and second shafts to rotate simultaneously to effect switch operation.

In the triangular configuration, the second base member may be formed in two sections and bolted together in such a way that the second base member can be disassembled during shipment after the switch arrangement has been assembled and tested.

Thus, it is a primary object of the present invention to provide a polyphase disconnecting switch arrangement that is highly flexible in construction and arrangement to meet the diverse needs of utility customers.

Yet another object of the present invention is to provide a polyphase disconnecting switch arrangement of the triangular configuration type which allows easy disassembly after manufacture and check out so that the switch arrangement can be easily shipped and reassembled in the field without further adjustment.

These and other objects, advantages and features shall hereinafter appear, and for the purposes of illustration, but not for limitation, exemplary embodiments of the present invention are illustrated in the accompanying drawings.

DETAILED DESCRIPTION OF THE PREFERRED EMBODIMENTS

Figure 1:
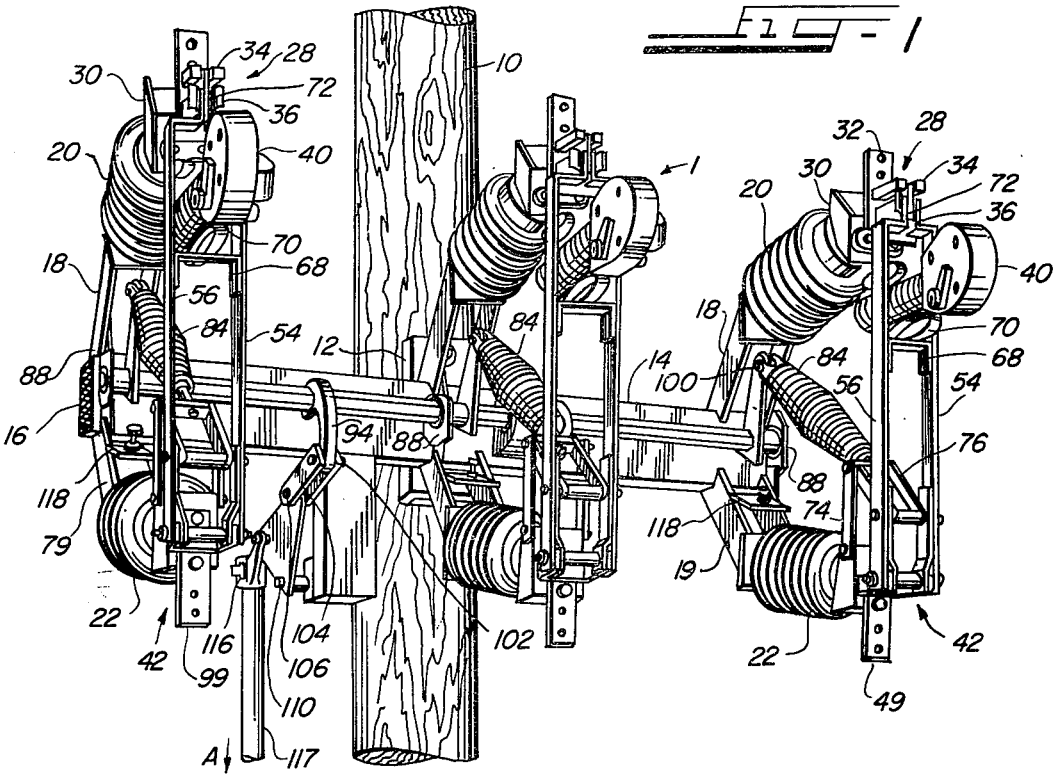
FIG. 1 is a left front perspective view of a polyphase disconnecting switch arrangement in accordance with the present invention.
Figure 2:
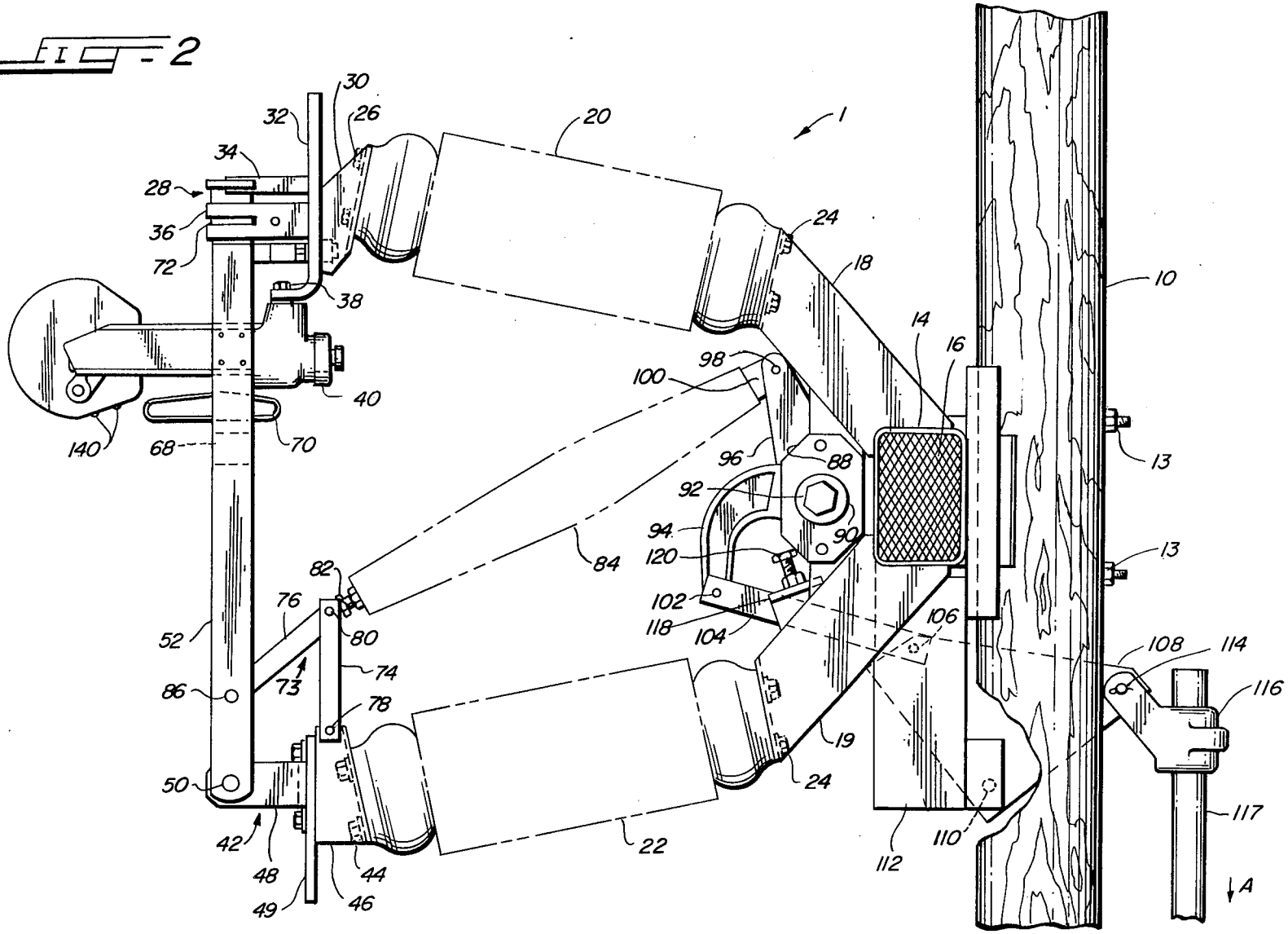
FIG. 2 is a right side view of the embodiment of the present invention illustrated in FIG. 1.
Figure 3:
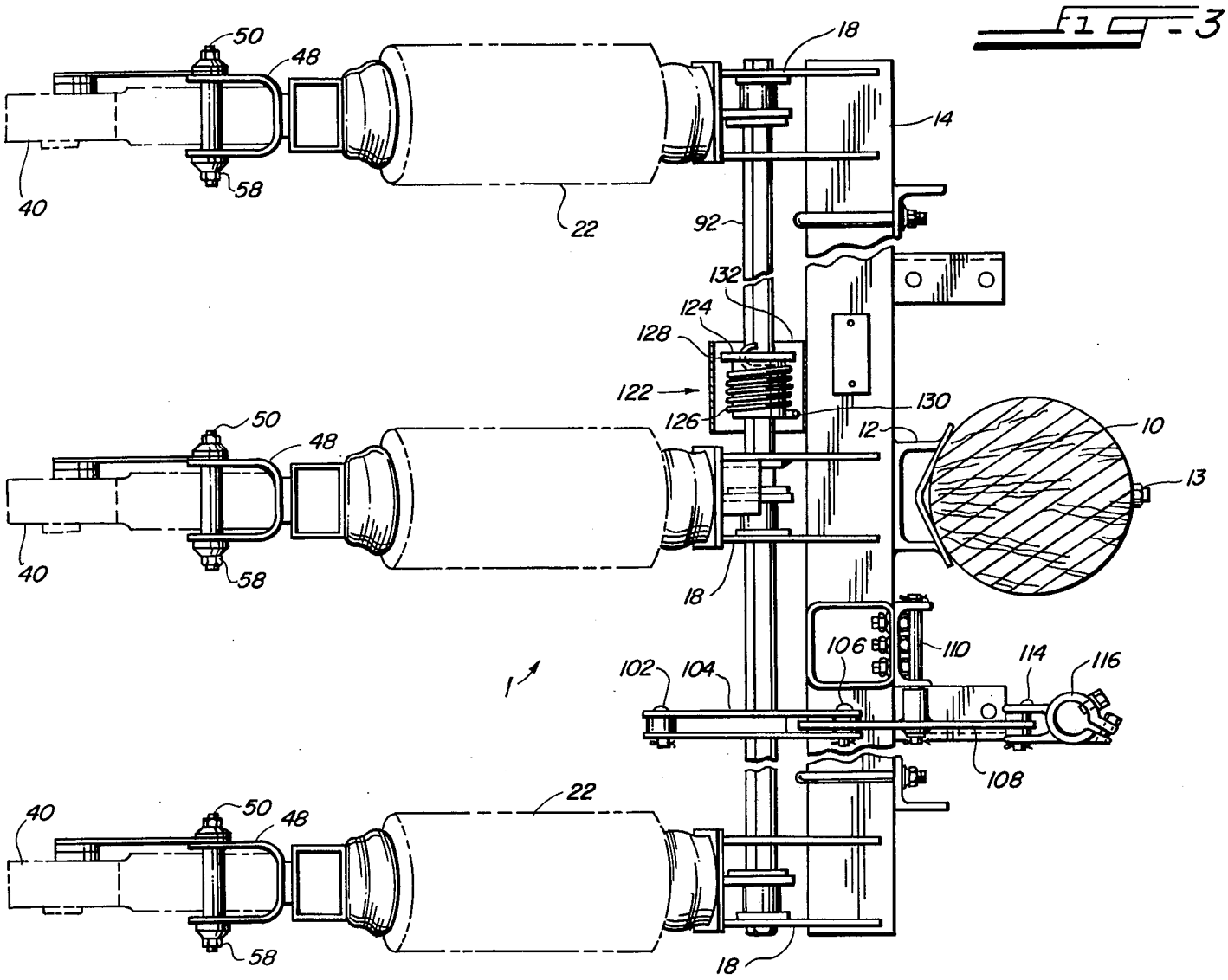
FIG. 3 is a bottom, partially cross-sectional view of the embodiment illustrated in FIG. 1.
Figure 4:
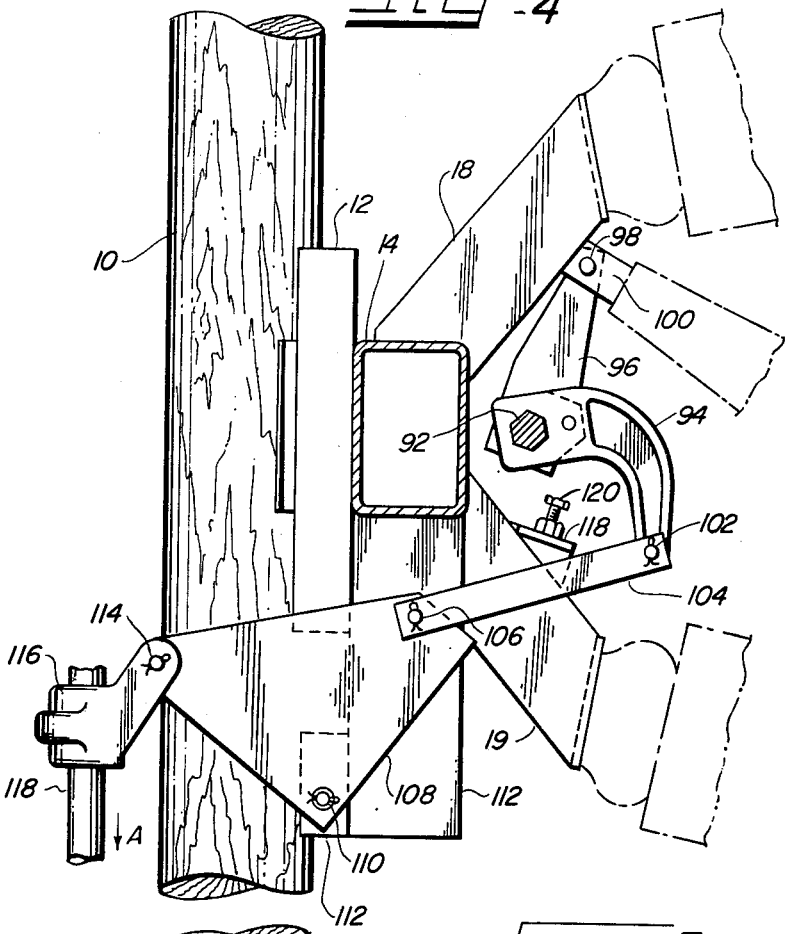
FIG. 4 is a left, partially cross-sectional, side view of the embodiment illustrated in FIG. 1.
Figure 14:
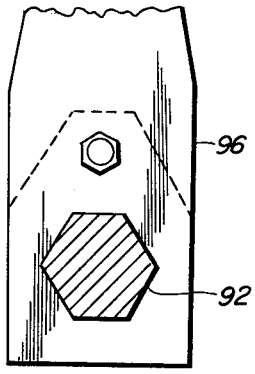
FIG. 14 is a side view of another one of the levers of the present invention.

With reference to FIGS. 1, 2 and 3 an improved polyphase disconnecting switch arrangement 1 is shown mounted to a supporting structure such as a utility pole 10. Switch arrangement 1 comprises a mounting block 12 that can be bolted to utility pole 10 by bolts 13. Mounted on mounting block 12 is a hollow metal box member 14 having wire mesh 16 welded over the ends thereof to prevent birds and insects from nesting in the interior of box member 14. Three sets of first and second arms 18 and 19 are welded to box member 14 and extend outwardly at an angle with respect to box member 14. Respectively mounted on the extended ends of arms 18 and 19 by bolts 24 are first and second insulators 20 and 22. Mounted on the end of first insulators 20 by bolts 26 are contact assemblies 28 each of which comprise an adapter bracket 30, a terminal pad 32, striking contact fingers 34 and stationary electrical contacts 36. Also mounted on terminal pad 32 by bolts 38 is interrupter unit 40. Interrupter unit 40 may conveniently take the form of the interrupter unit disclosed in U.S. Pat. No. 3,909,570 or may take the form of the interrupter unit disclosed in co-pending application, Ser. No. 775,904, filed Mar. 9, 1977 and, assigned to the same assignee as the present invention.

Figure 16:
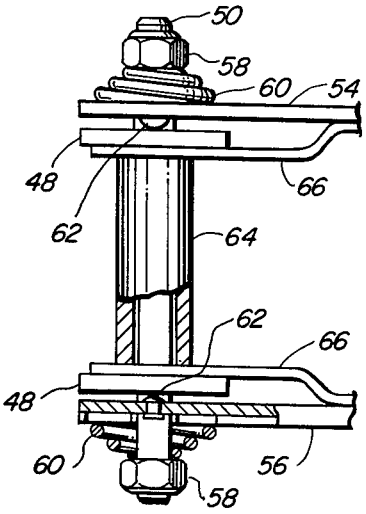
FIG. 16 is a top, partially fragmentary, partially cross-sectional, view of the hinge arrangement for the switch blade.

Mounted on the end of second insulators 22 by bolts 44 are switch blade arrangements 42, each comprising hinge adapter bracket 46, terminal pad 49, a hinge assembly 48 mounted thereon, and a switch blade assembly 52 pivotably mounted on the free end of hinge assembly 48 by a shaft 50. Switch blade assembly 52 comprises two arms 54 and 56 which straddle hinge assembly 48. With reference to FIG. 16, the ends of shaft 50 are threaded to accept nuts 58 so that when tightened, nuts 58 compress springs 60 so that arms 54 and 56 are pressed towards hinge assembly 48 so that rubbing contacts 62 maintain electrical connection with hinge assembly 48 as switch blade assembly 52 is pivoted. A spacer 64 is positioned over shaft 50 and rides between blade stiffeners 66 riveted to arms 54 and 56.

With reference to FIGS. 1 and 2, a separator member 68 is mounted between arms 54 and 56, and a spring contact 70 is mounted on separator member 68 in a position to engage contact buttons 140 on interrupter unit 40 as will be more fully described hereinafter. The ends of arms 54 and 56 are bent and joined to form a blade contact 72 which engages stationary contact 36.

Switch blade arrangements 42 each also includes a linkage 73 which comprises links 74 and 76. Links 74 are pivotably mounted at one end by pins 78 to hinge adapter bracket 46. The other end of each link 74 is pivotably mounted by a pin 80 to one end of each link 76 and also to a clevis 82 mounted on the end of push rod insulator 84. The other end of each link 76 is pivotably mounted to arms 54 and 56 by a pin 86. The linkage 73 is more completely described and claimed in the commonly assigned, co-pending application, Ser. No. 775,905, filed Mar. 9, 1977.

Welded to and extending between arms 18 and 19 are bearing brackets 88 through which are mounted bearings 90. Bearings 90 rotably support a polygonally-shaped shaft preferably a hexagonal-shaped shaft 92 which extends the full length of box member 14. A drive lever 94 having a mating hexagonal opening through one end thereof is locked on shaft 92 in a manner that will be hereinafter more fully described. Also mounted on shaft 92 in a manner that will be described hereinafter adjacent each of the push rod insulators 84 are levers 96. Levers 96 also have a mating hexagonal opening through the end thereof that engage shaft 92 so that when shaft 92 is rotated, levers 96 are rotated. The end of each of levers 96 is pivotably connected by a pin 98 to a clevis 100 mounted on the other end of push rod insulators 84.

Pivotably mounted by pin 102 to the curved end of drive lever 94 are drive-connecting links 104. The other ends of drive-connecting links 104 are pivotably connected by a pin 106 to a bell crank member 108. Bell crank member 108 is substantially triangular in shape and at one intermediate apex a pin 110 pivotably mounts bell crank member 108 to a support block 112 which is welded to the bottom of box member 14. Pivotably mounted at another apex of bell crank member 108 by a pin 114 is a rod connector 116 which is attached to the end of a movable operating rod 117 which is connected to a remote switch operator (not shown). Mounted on arm 19 is a stop bracket 118 and an adjustable stop 120 is mounted thereon in a position to engage lever 96 as will be described below.

With specific reference to FIG. 3, a counter weight spring assembly 122 comprising a sleeve 124 having a hexagonal opening through the center thereof that mates with hexagonal shaft 92 is positioned over shaft 92 so that when shaft 92 rotates, sleeve 124 will also rotate. A coil spring 126 is positioned around sleeve 124, and one end of spring 126 is inserted through an opening in a flange 128 on sleeve 124. The other end of spring 126 is inserted through an opening 130 in housing 132. Housing 132 is welded to box member 14. Thus, when shaft 92 is rotated, spring 126 is wound to compensate for and counter balance the weight of switch blade assembly 52 when switch blade assembly 52 is moved from a vertical position to a horizontal position.

With reference to FIGS. 1, 2, 3, 4, 7 and 8, the basic operation of switch arrangement 1 will be described. In an ordinary installation, switch assembly 1 would be connected across three phase electrical circuit with one side of each line of the high-voltage circuit connected to a respective terminal pad 32 and the other side of the line of the high-voltage circuit connected to a respective terminal pad 49 so that three phase electrical circuit is completed through switch blade assemblies 52 and contacts 36. When it is desired to open the switch arrangement 1, operating rod 117 is moved downwardly in the direction of the arrow A causing bell crank 108 to pivot around pin 110 in turn causing drive link 104 to pivot drive lever 94 so that shaft 92 is rotated. The rotation of shaft 92 causes lever 96 to pivot to cause push rod insulator 84 to move outwardly against the pinned junction of links 74 and 76.

Figure 7:
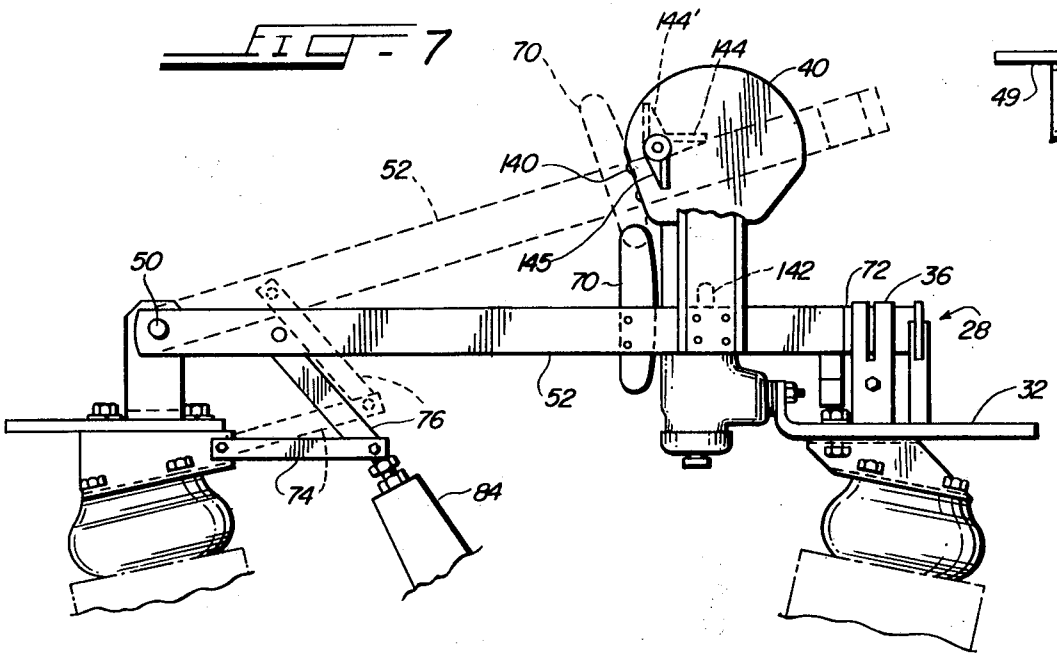
FIG. 7 is a side, partially fragmentary view of the switch blade and interrupter unit of the present invention.

With specific reference to FIG. 7, as push rod insulator 84 is moved, links 74 and 76 cause switch blade assembly 52 to pivot about shaft 50 until the blade contact end 72 of switch blade assembly 52 disengages stationary electrical contacts 36 of contact assembly 28 as shown in dotted lines. However, as switch blade assembly 52 is pivoted, spring contact 70 engages contact buttons 140 on interrupter unit 40 completing an electrical circuit through the interior of interrupter unit 40 to back-up plate 32 before switch blade assembly 52 disengages stationary contact 36. Thus, there is a parallel current path through interrupter unit 40 at the time switch blade assembly 52 disengages contacts 36 so no electrical arc is formed at contact assembly 28.

As previously pointed out, interrupter unit 40 may comprise the interrupter unit disclosed in U.S. Pat. No. 3,909,570 or the interrupter unit disclosed in patent application Ser. No. 775,904, filed Mar. 9, 1977 and assigned to the same assignee as the present invention. For the purposes of the present description, it need be only understood that interrupter unit 40 will continue to provide a parallel electrical path until such time as a cam 142 mounted on switch blade assembly 52 engages a trigger 144 (shown in dotted lines) on the far side of interrupter unit 40 causing trigger 144 to pivot to the position shown by the dotted lines 144 in FIG. 7. When trigger 144 is pivoted, the internal mechanism of interrupter unit 40 (not shown) causes the circuit to be interrupted at a time when the blade contact 72 of switch blade assembly 52 is a sufficient distance from contact 36 so that an electrical arc will not form between them. Thus, external arcing between contacts 36 and switch blade assembly 52 is avoided when current is interrupted.

Figure 8:
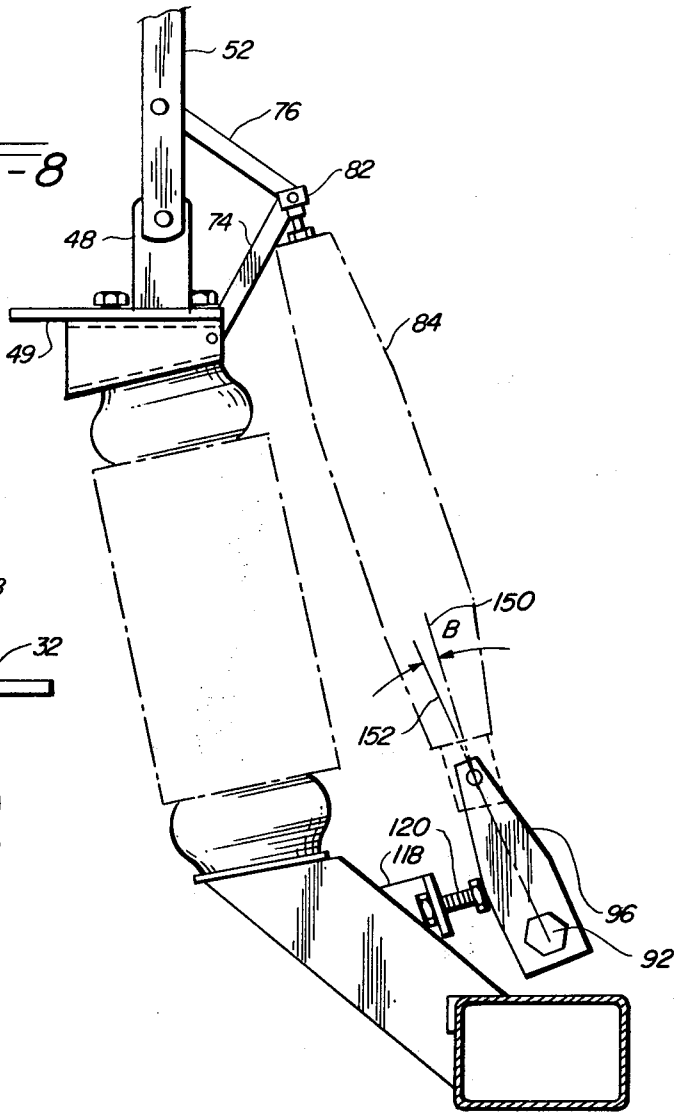
FIG. 8 is a side, partially fragmentary, cross-sectional view of the switch blade, push rod insulator and linkage of the present invention in an open position.

Shaft 92 rotates until lever 96 engages adjustable stop 120 (see FIG. 8). In this position, the center line 150 of push rod insulator 84 forms a slight angle B with respect to the center line 152 of lever 96. Thus, lever 96 and push rod insulator 84 are at an over-center toggle position so that wind and other external forces applied to switch blade assembly 52 cannot cause switch blade assembly 52 to pivot back into engagement with contacts 36.

When it is desired to close switch assembly 1, rod 117 is moved in the opposite direction of arrow A so that shaft 92 is rotated in the opposite direction causing push rod insulator 84 to pull against links 74 and 76 so that switch blade assembly 52 is pivoted back until it is in the position illustrated in FIGS. 1, 2 and 3. As switch blade assembly 52 is pivoted back, another cam (not shown) engages a trigger 144 on the near side of interrupter unit 40 causing interrupter unit 40 to operate to close its internal contacts (not shown) so that interrupter unit 40 is ready for the next switch-opening operation.

With reference to FIGS. 12A, 12B, 13, 14, and 15, the means of attaching drive lever 94 and lever 96 to hexagonal shaft 92 is illustrated. As previously pointed out, drive lever 94 and lever 96 have a hexagonal opening through one end thereof that mates with hexagonal shaft 92. A locking member 160 is designed to lock levers 94 and 96 to shaft 92 at desired positions along shaft 92. Locking member 160 has formed through one end thereof a round bolt hole 162 and through the other end thereof a hexagonal opening 164 which is formed at an acute small angle C (see FIG. 13) with respect to a perpendicular line 163 to the surface of locking member 160.

Figure 15:
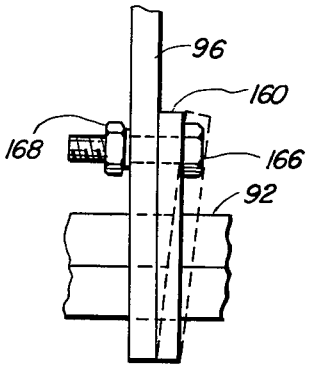
FIG. 15 is an end view of the lever illustrated in FIG. 14 showing the locking arrangement.
Figures 11, 12A, 12B, 13:
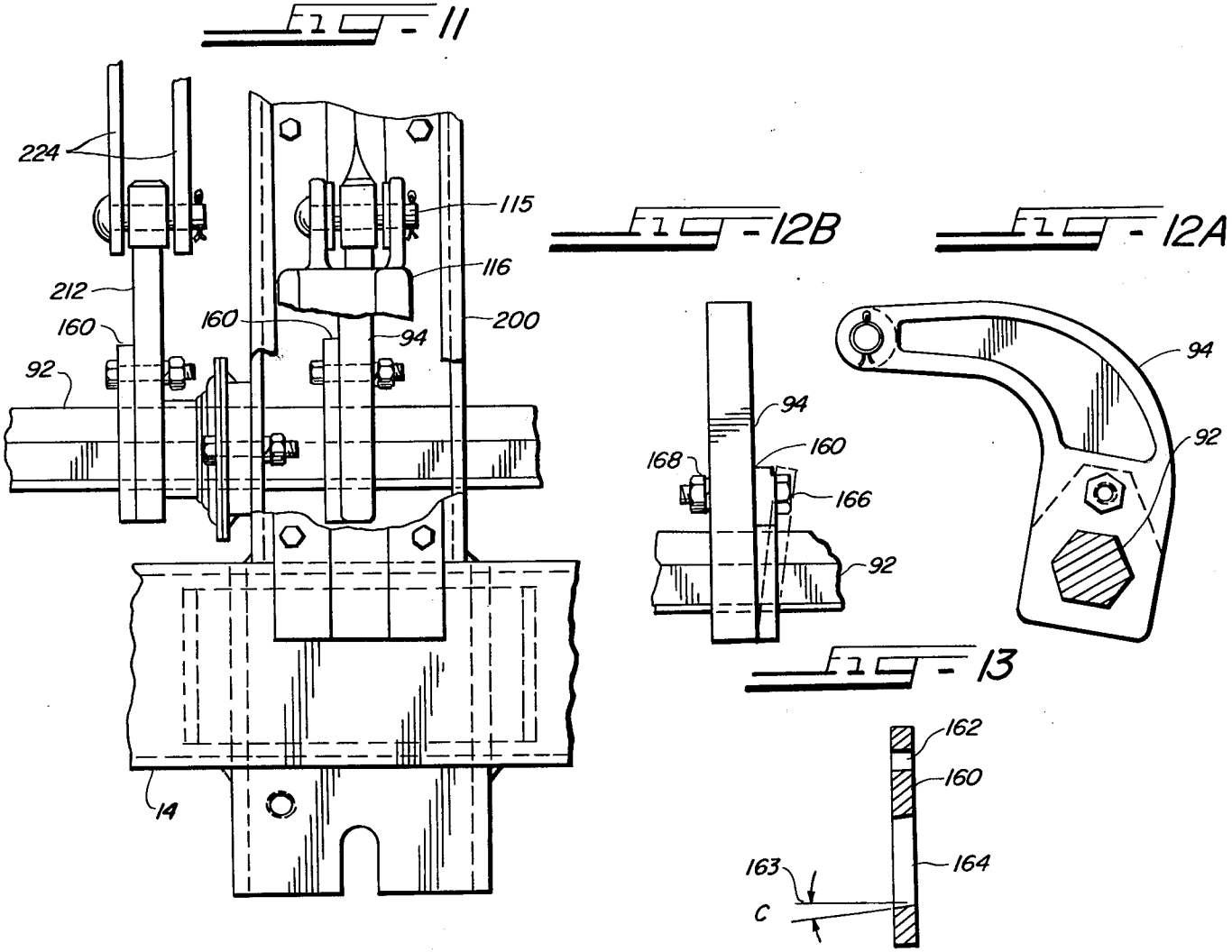
FIG. 11 is an enlarged view of a section of the embodiment illustrated in FIG. 10.
FIG. 12A is a side view of a drive lever in accordance with the present invention.
FIG. 12B is an end view of the drive lever illustrated in FIG. 12A showing the locking arrangement for the drive lever.
FIG. 13 is a cross-sectional view of a locking member in accordance with the present invention.

Thus, when placed over shaft 92, locking member 160 initially takes the position illustrated by the dotted lines in FIGS. 12B and 15 so that the upper end is away from the surface of the levers 94 or 96. A bolt 166 is then inserted through the hole 162 and a corresponding opening in either lever 94 or lever 96 and a nut 168 is tightened until locking member 160 is in the position illustrated in solid lines in FIGS. 12B and 15. Because of the angle C of opening 164, the edges of opening 164 in locking member 160 engage shaft 92 locking levers 94 and 96 on shaft 92 at the desired location. This is an extremely desirable feature of the present invention since it permits easy assembly and a wide variation of constructions and positions of levers 94 and 96 without altering the basic configuration of the various parts of the switch arrangement 1.

Figure 5:
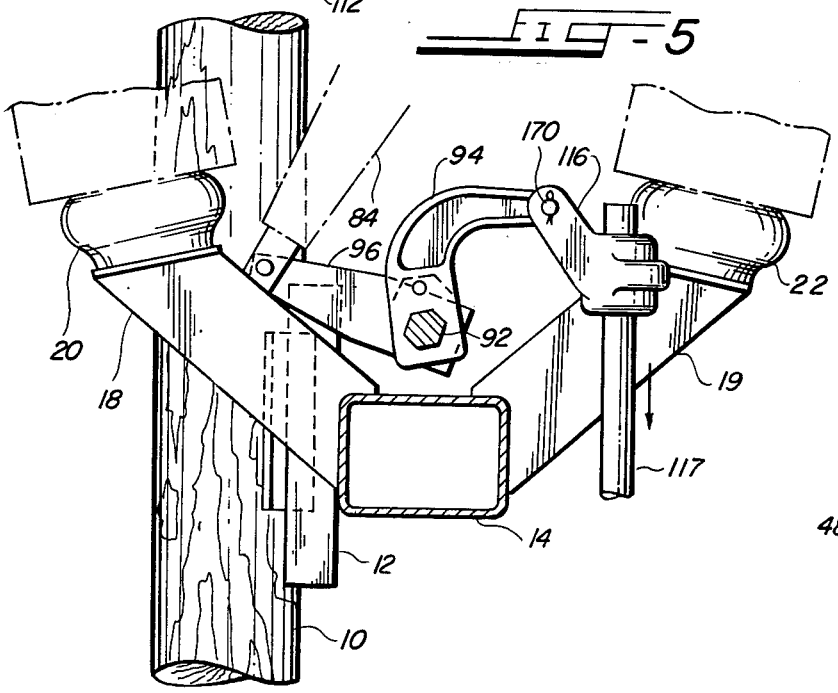
FIG. 5 is a side, partially cross-sectional, view of an alternative embodiment of the present invention.

With reference to FIG. 5, a slightly different embodiment of the present invention is illustrated which demonstrates the flexibility of the present invention. Since most of the structure is similar to that previously described, the same reference numerals will be used except where there is a difference in structure. In this embodiment, mounting block 12 is welded to a different side of box member 14 so that arms 18 and 19 and insulators 20 and 22 extend substantially in a vertical direction rather than substantially in a horizontal direction as illustrated in FIG. 1. In this configuration, rod connector 116 is directly and pivotably connected to drive lever 94 by a pin 170 so that operating rod 117 extends vertically and essentially parallel to utility pole 10. Because of this vertical arrangement the drive connecting links 104 and the bell crank 108 (see FIGS. 1, 2, 3, and 4) can be eliminated. The FIG. 5 embodiment operates the same way as the embodiment illustrated in FIGS. 1, 2, 3, and 4 when rod 117 is moved to open and close the switch arrangement as previously described.

Figure 6:
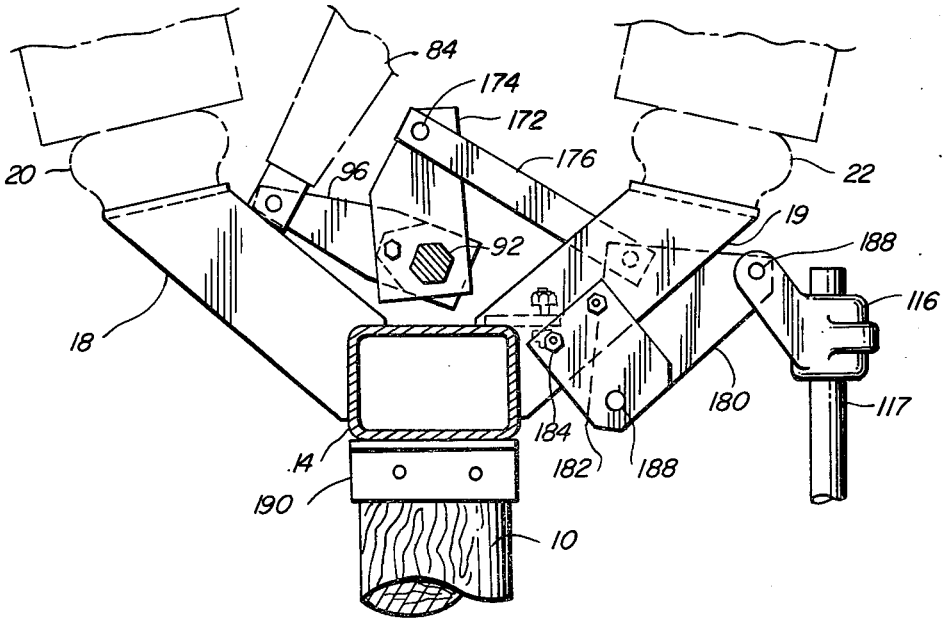
FIG. 6 is a side, partially cross-sectional, view of yet another embodiment of the present invention.

FIG. 6 illustrates yet another embodiment of the present invention where the switch arrangement is mounted on top of utility pole 10. Since most of the structure is identical to that previously described, the same reference numeral will be used except where there is a difference in structure.

In the FIG. 6 embodiment, a mounting bracket 190 is welded to the bottom of box member 14. Mounting bracket 190 is adapted to permit the switch arrangement to be mounted on top of utility pole 10 in the manner illustrated. A slightly different configuration of drive lever 172 is attached to shaft 92 in the manner previously described. Drive lever 172 is pivotably connected by a pin 174 to a drive link 176. The other end of drive link 176 is pivotably connected by a pin 178 to a bell crank member 180. A support bracket 182 is bolted to arm 19 by bolts 184, and one intermediate apex of bell crank member 180 is pivotably connected by a pin 186 to support bracket 182. Another apex of bell crank member 180 is pivotably connected by a pin 188 to rod connector 116. Thus, it can be seen that when drive rod 117 is moved downwardly, bell crank 180 pivots around pin 186 in a clockwise direction causing drive link 176 to pivot drive lever 172 in a clockwise direction causing shaft 92 to rotate pivoting lever 96 in a clockwise direction thus pushing push rod insulator 84 in an upward direction. Consequently, it can be seen that the FIG. 6 embodiment operates in substantially the same manner as the other embodiments to permit the opening and closing of the switch arrangement 1.

Figure 9:
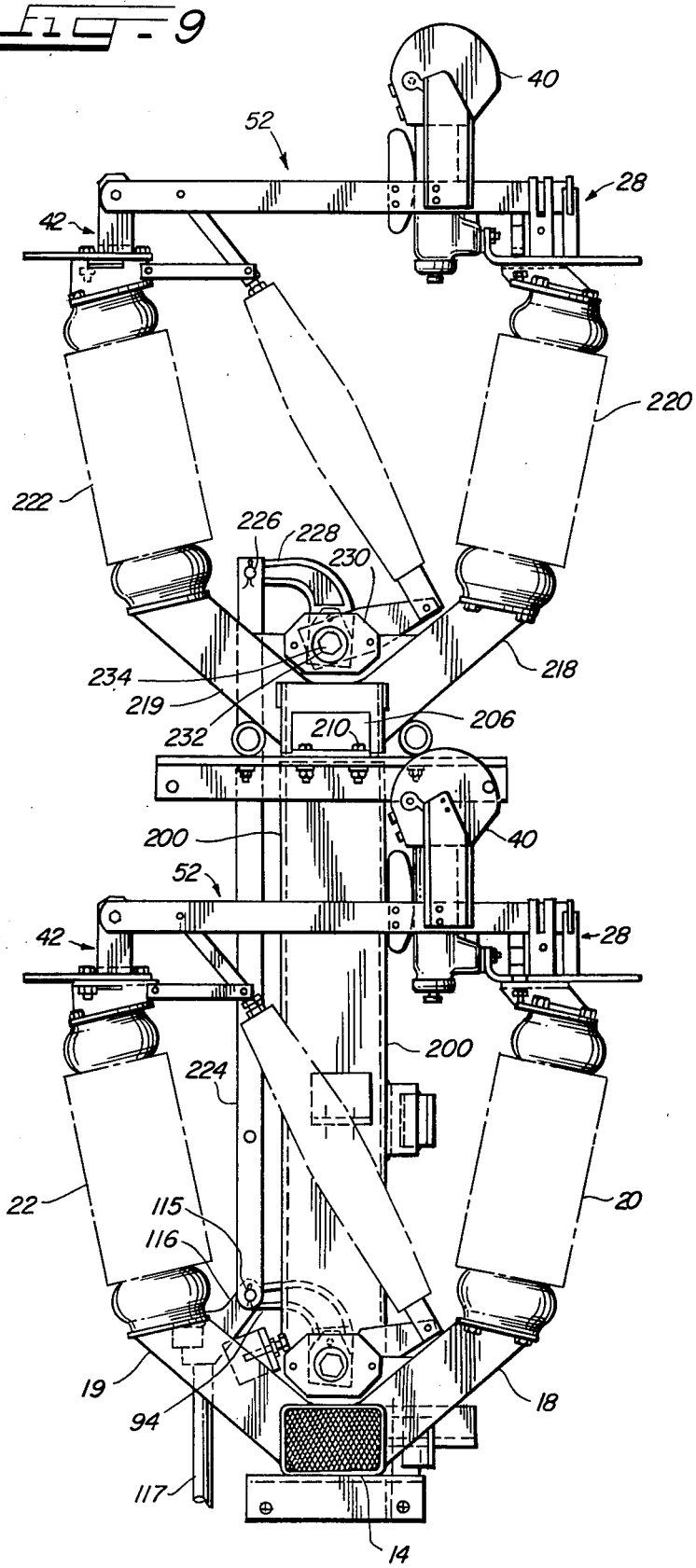
FIG. 9 is a side elevational view of yet another embodiment of the present invention.
Figure 10:
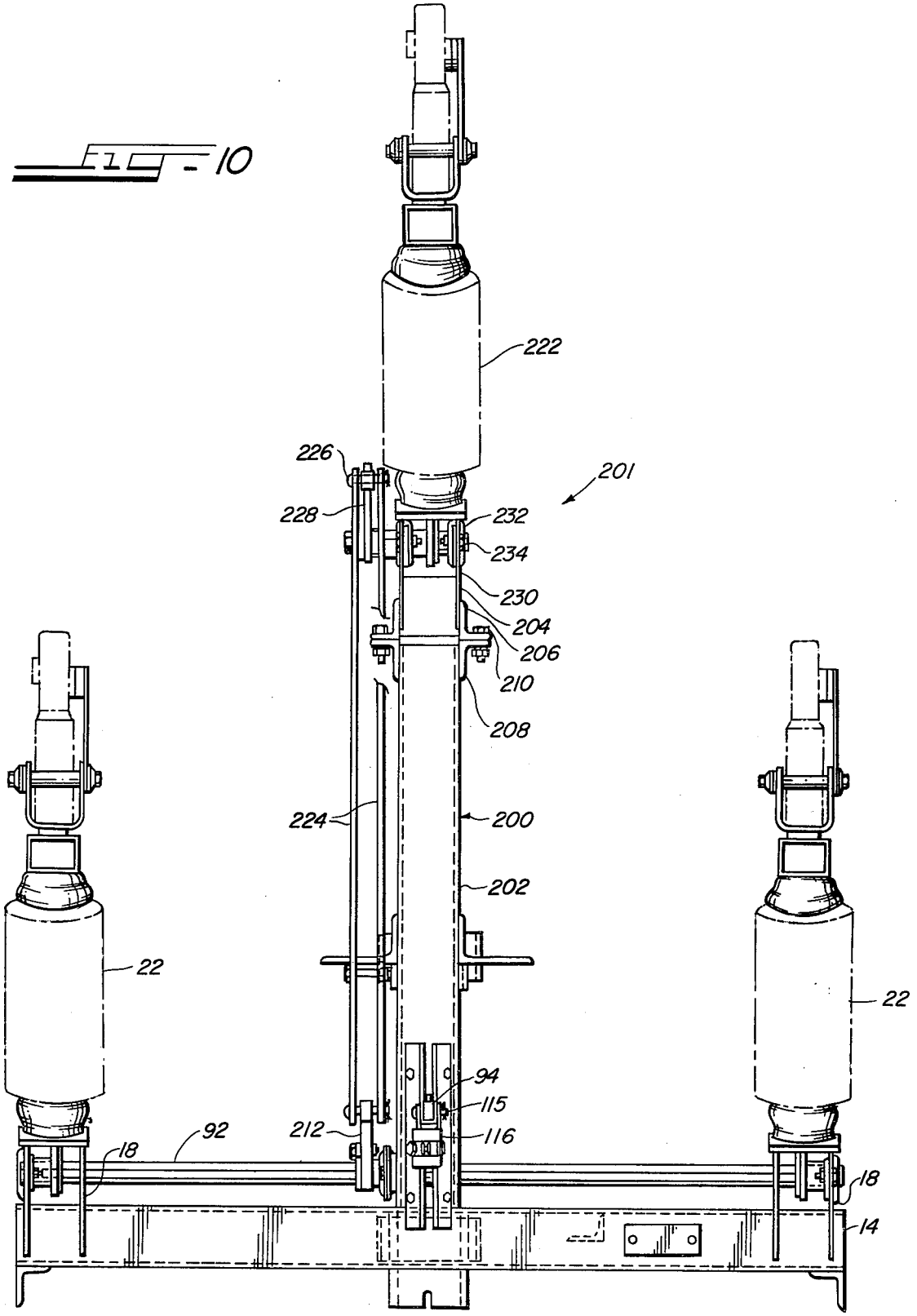
FIG. 10 is a front elevational view of the embodiment illustrated in FIG. 9.

With reference to FIGS. 9, 10, and 11, yet another alternative embodiment of the present invention is illustrated showing another configuration of the switch arrangement. In this embodiment, the switch is arranged in a triangular configuration for use in electrical power distribution systems wherein the conductors are arranged in a triangular configuration with a conductor at each apex of the triangle. The principle operating parts of this configuration are substantially the same as previously described so the same numeral will be used where appropriate, and only those portions of this configuration which are different from the prior configurations will be described in detail with different numbers. The principal difference between this embodiment and the prior embodiments is that the center switch arrangement is mounted on a vertically extending base member 200 which is welded to box member 14 and extends vertically and substantially perpendicular therefrom. On each end of the box member 14, arms 18 and 19, insulators 20 and 22 and the switch blade arrangements 42 and contact assemblies 28 described with respect to the FIG. 1 embodiment are mounted.

Welded to the top of base member 200 are an additional third set of arms 218 and 219 upon which are respectively mounted insulators 220 and 222 which are substantially the same as insulators 20 and 22. Switch blade arrangements 42 and contact assemblies 28 are mounted on insulators 220 and 222. As in the previous embodiment, a hexagonal shaft 92 is mounted for rotation and extends the entire length of box member 14. A drive lever 94 is mounted on hexagonal shaft 92 in the manner previously described within the hollow interior of base member 200 and a rod connector 116 is pivotably pinned by pin 115 to the end of drive lever 94. Another lever 212 is also mounted on shaft 92 in the manner previously described and pivotably pinned to the end of drive lever 212 are vertically extending connecting links 224 which extend parallel to base member 200. Links 224 are pivotably connected at their opposite end by a pin 226 to another drive lever 228.

Mounted between arms 218 and 219 at the top of base member 200 are bearing brackets 230 which support bearings 232 through which a short hexagonal shaft 234 is mounted for rotation. Drive lever 228 is mounted on the end of shaft 234 in the manner previously described so that when connecting links 224 are moved, drive lever 228 is pivoted, rotating shaft 234. Thus, it can be seen when operating rod 117 is moved downwardly, drive levers 94, 212 and 228 are pivoted simultaneously thereby rotating their respective shafts 92 and 234. The remaining operation of the switch arrangement illustrated in FIGS. 9 and 10 is exactly the same as previously described with respect to the FIG. 1 embodiment.

An additional feature of the FIGS. 9 and 10 embodiment resides in the fact that base member 200 can be "split" to facilitate shipment. Base member 200 comprises two sections 202 and 204 which are joined at brackets 206 and 208 which are bolted together by bolts 210.

The advantage of this arrangement is that switch arrangement 201 can be partially disassembled during shipment to reduce the size of the configuration. However, after manufacture and assembly, the switch arrangement 201 can be checked for proper adjustment and proper operation in the factory before shipment. After the switch arrangement 201 has been checked out, connecting links 224 can be disconnected, and bolts 210 removed so that base number 200 can be "split" and the switch arrangement 201 can be more easily shipped. During installation in the field, since there has been no change in the adjustment of the system, it is only necessary for the customer to re-bolt the upper portion 204 to the end lower portion 202 and connect the connecting links 224 for the switch arrangement to be ready for installation and use. No field adjustments are required.

It should be apparent from the foregoing, that because of the flexibility of the present invention, a variety of different configurations and pole mountings are possible. The embodiments illustrated herein are some of the typical representative examples of the various configurations that are possible because of the flexible design of the present invention. Further, it should be apparent to one skilled in the art that various changes, alterations, and modifications may be made to the structure of the present invention without departing from the spirit and scope of the present invention as defined in the appended claims.

It should be further apparent that in applications where a current interruption function is not required, omission of the interrupter unit 40 from the above described embodiments will provide polyphase disconnect switches within the scope of this invention.

We claim:

1. A polyphase disconnecting switch arrangement comprising:
- a base member suited for mounting on a support structure;
- a polygon-shaped shaft mounted for rotation on said base member;
- a first lever mounted on said shaft for rotating said shaft;
- means for pivoting said first lever to rotate said shaft;
- at least one set of support arms mounted on said base member and extending outwardly therefrom;
- first and second insulators respectively mounted on the extending ends of said support arms;
- stationary electrical contact means mounted on said first insulator;
- switch blade means pivotably mounted on the second insulator, said switch blade means normally engaging said stationary electrical contact means to complete an electrical circuit, said switch blade means being pivotable to disengage said stationary contact means;

a second lever mounted at one end on said shaft adjacent said first and second arms;

a push rod insulator pivotably connected at one end to the other end of said second lever;

means pivotably interconnecting the other ends of said push rod insulator with said switch blade means;

whereby, when said means for pivoting said first lever causes said shaft to rotate, said second lever causes said push rod insulator to pivot said switch blade means to disengage said stationary contact means to open the electrical circuit between said stationary contact means and said switch blade means;

locking means for individually locking said first lever and said second lever to said shaft and permitting said levers to be adjustably positioned along the length of said shaft, wherein said locking means comprises a respective locking member for each of said first and said second levers, said locking member having a polygon-shaped opening formed therethrough dimensioned to slidably mate with said shaft, said opening formed at an angle such that when said respective locking member is bolted to said first or said second levers, the edges of said opening engage said shaft locking said first and said second levers to said shaft.

2. A switch arrangement, as claimed in claim 1, wherein said base member may be mounted to the supporting structure so that said switch blade means is in a substantially vertical alignment.

3. The switch arrangement, as claimed in claim 1, wherein said base member may be mounted to the supporting structure so that said switch blade means is in a substantially horizontal alignment.

4. A switch arrangement, as claimed in claim 1, wherein said means for pivoting said first lever comprises:

a drive link pivotably connected at one end to said first lever;

a bell crank member mounted for rotation intermediate its ends, one end of said bell crank member pivotably connected to the other end of said drive link;

a movable operating rod pivotably connected to the other end of said bell crank member.

5. A switch arrangement, as claimed in claim 1, wherein said means for pivoting said first lever comprises a movable operating rod pivotably connected to said first lever.

6. A switch arrangement, as claimed in claim 1, further comprising adjustable stop means mounted adjacent to said second lever for stopping rotation of said second lever after said switch blade means has been opened in a position such that said second lever and said push rod insulator form an overcenter toggle so that said switch blade means cannot be closed into said stationary contact means by external forces applied to said switch blade means.

7. A switch arrangement, as claimed in claim 1, further comprising interrupter switch means mounted on said stationary electrical contact means for interrupting current flow when said switch blade means is sufficiently separated from said stationary contact means to prevent formation of an electrical arc there between.

8. A polyphase disconnecting switch arrangement comprising:

a first base member for being mounted to a supporting structure;

a first polygonally-shaped shaft mounted for rotation on said first base member;

a first lever mounted on said shaft for rotating said first shaft;

means for pivoting said first lever to rotate said first shaft;

first and second sets of first and second arms, the first set of first and second arms mounted at one end of said first base member and the second set of first and second arms mounted to the other end of said first base member, both sets of first and second arms extending outwardly therefrom;

a first and second set of first and second insulators respectively mounted on the extended ends of said first and second arms;

a second base member mounted at one end thereof centrally of said first base member and extending essentially perpendicularly to said first base member and generally parallel to said insulators;

a second polygonally-shaped shaft mounted for rotation at the other end of said second base member;

a third set of first and second arms mounted to the other end of said second base member and extending outwardly therefrom;

a third set of first and second insulators respectively mounted to said first and second arms of said third set;

three second levers, two of said second levers respectively mounted to said first shaft adjacent said first and second sets of arms; the third of said second levers mounted to said second shaft adjacent said third set of arms;

stationary electrical contact means mounted on each of said first insulators;

switch blade means pivotably mounted on each of said second insulators, said switch blade means normally engaging said stationary electrical contact means to complete an electrical circuit, said switch blade means being pivotable to disengage said stationary electrical contact means;

three push rod insulators; each being pivotably connected at one end to the other end of a respective second lever;

means interconnecting the other end of each of said push rod insulators with a respective switch blade means;

a third lever connected to said second shaft for rotating said second shaft;

means interconnecting said first lever and said third lever so that when said means for pivoting said first lever rotates said first shaft, said third lever is pivoted to rotate said second shaft;

whereby, when said means for pivoting said first lever causes said first and second shafts to rotate, said second levers cause said push rod insulators to pivot said switch blade means to disengage said stationary electrical contact means to open the electrical circuit between said stationary contact means and said switch blade means;

wherein said first lever, said second levers, and said third lever are respectively locked to said shafts by a locking means that permits said levers to be adjustably positioned along the length of said shafts, wherein said locking means comprises a locking member having a polygonally-shaped opening formed therethrough dimensioned to slidably mate with shaft, said opening formed at an angle such that when said locking member is bolted to said levers, the edges of said opening engage said shaft locking said levers to said shaft.

9. A switch arrangement, as claimed in claim 8, wherein said means for pivoting said first lever comprises:

a drive link pivotably connected at one end to said first lever;

a bell crank member mounted for rotation intermediate its ends, one end of said bell crank member pivotably connected to the other end of said drive link;

a movable operating rod pivotably connected to the other end of said bell crank member.

10. A switch arrangement, as claimed in claim 8, further comprising adjustable stop means mounted adjacent to said second levers for stopping rotation of said second levers after said switch blade means has been opened at a position such that said second levers and said push rod insulator form an overcenter toggle so that said switch blade means cannot be closed into said stationary contact means by external forces applied to said switch blade means.

11. A polyphase disconnecting switch arrangement, as claimed in claim 8, wherein said second base member comprises a first and a second sections, said first section connected at one end to said first base member, said second section having the third set of arms mounted to one end thereof, the other ends of said first and second sections being separably connected so that said switch arrangement can be partially disassembled during shipment.

12. A switch arrangement, as claimed in claim 8, further comprising interrupter switch means mounted on said stationary electrical contact means for interrupting current flow when said switch blade means is sufficiently separated from said stationary contact means to prevent formation of an electrical arc there between.

13. A polyphase disconnecting switch arrangement comprising:

a base member suited for mounting to a supporting structure;

a polygon-shaped shaft mounted for rotation on said base member;

means for rotating said shaft;

at least one set of support arms mounted on said base member and extending outwardly therefrom;

first and second insulators respectively mounted on the extending ends of said support arms;

stationary electrical contact means mounted on said first insulator;

interrupter switch means mounted on said stationary electrical contact;

switch blade means pivotably mounted on the second insulator, said switch blade means normally engaging said stationary electrical contact means to complete an electrical circuit, said switch blade means being pivotable to disengage said stationary contact means;

a lever mounted at one end on said shaft adjacent said support arms;

a push rod insulator pivotably connected at one end to the other end of said lever;

means pivotably interconnecting the other ends of said push rod insulator with said switch blade means;

whereby, when said means for rotating said shaft causes said shaft to rotate, said lever causes said push rod insulator to pivot said switch blade means to disengage said stationary contact means while said switch blade means maintains electrical circuit connection through said interrupter switch means, said interrupter means being operable to interrupt current flow when said switch blade means is sufficiently separated from said stationary contact means to prevent formation of an electrical are there between;

wherein said second lever is locked to said shaft by a locking means that permits said lever to be adjustably positioned along the length of said shaft, wherein said locking means comprises a locking member having a polygon-shaped opening formed therethrough dimensioned to slidably mate with said shaft, said opening formed at an angle such that when said locking member is bolted to said lever, the edges of said opening bind said shaft to lock said lever to said shaft.

14. A switch arrangement, as claimed in claim 13, wherein said base member may be mounted to the supporting structure so that said switch blade means is in a substantially vertical alignment.

15. A switch arrangement, as claimed in claim 13, wherein said base member may be mounted to supporting structure so that said switch blade means is in a substantially horizontal alignment.

16. In a switch arrangement of the type having a stationary electrical contact insulatively spaced from and mounted on a base; a switch blade pivotal about a point insulatively spaced from and mounted on the base, the blade being selectively engageable with the contact; and an insulative push rod connected to the blade, reciprocation of the push rod pivoting the blade; improved means for connecting the push rod to a reciprocable switch operator, wherein the improvement means comprises:

a shaft having a non-circular cross section mounted for rotation on the base;

a first lever connected between the operator and the shaft for rotating the shaft in response to reciprocation of the operator;

a second lever connected between the shaft and the push rod for reciprocating the push rod in response to rotation of the shaft; and a locking member for locking each lever to the shaft, the locking member comprising:

a plate having a non-circular opening complementary to the shaft therethrough, the axis of the opening being skewed relative to the plane of the plate, and means for holding the plate against the lever to engage the shaft with the edges of the opening and thereby lock the lever thereto, the plate and the lever being freely positionable along the shaft when the plate is away from the lever and the axes of the opening and the shaft are not coaxial.

* * * * *

UNITED STATES PATENT AND TRADEMARK OFFICE

CERTIFICATE OF CORRECTION

PATENT NO. : 4,126,773

DATED : November 21, 1978

INVENTOR(S) : Joseph Bernatt and Karel Vojta

It is certified that error appears in the above-identified patent and that said Letters Patent are hereby corrected as shown below:

Column 12, line 15 - "are" should read "arc".

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*